US007037113B2

(12) United States Patent
Soh

(10) Patent No.: US 7,037,113 B2
(45) Date of Patent: May 2, 2006

(54) ELECTRICAL CONNECTOR

(75) Inventor: Lip Teck Soh, Singapore (SG)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/514,255

(22) PCT Filed: May 24, 2003

(86) PCT No.: PCT/SG03/00123

§ 371 (c)(1),
(2), (4) Date: Jun. 23, 2005

(87) PCT Pub. No.: WO03/100911

PCT Pub. Date: Dec. 4, 2003

(65) Prior Publication Data

US 2005/0250353 A1 Nov. 10, 2005

(30) Foreign Application Priority Data

May 24, 2002 (SG) ..... 200203161.5

(51) Int. Cl.
*H01R 12/00* (2006.01)

(52) U.S. Cl. ..... 439/66; 439/862

(58) Field of Classification Search ..... 439/66, 439/862, 885, 591

See application file for complete search history.

(56) References Cited

U.S. PATENT DOCUMENTS 4,699,593 A 10/1987 Grabbe et al. ..... 439/71
5,395,252 A * 3/1995 White ..... 439/66
5,479,320 A * 12/1995 Estes et al. ..... 361/785
5,498,166 A * 3/1996 Rothenberger ..... 439/66
5,746,607 A * 5/1998 Bricaud et al. ..... 439/66
5,951,303 A * 9/1999 Wilmsmann nee Sudmoller ..... 439/66
5,975,914 A * 11/1999 Uchida ..... 439/66
5,975,959 A * 11/1999 Joly ..... 439/630
5,980,268 A 11/1999 Mischenko et al. ..... 439/66
6,099,356 A 8/2000 Hwang ..... 439/660
6,231,394 B1 5/2001 Schnell et al. ..... 439/630

FOREIGN PATENT DOCUMENTS

FR 1 395 879 4/1995
WO WO 97/32275 9/1997

* cited by examiner

*Primary Examiner*—Tho D. Ta
(74) *Attorney, Agent, or Firm*—Harrington & Smith,LLP

(57) ABSTRACT

An electrical connector comprising a housing having a plurality of conductive element receiving regions within which a plurality of conductive elements are provided. The conductive elements are of a kind formed from an elongate sheet material which has been bent out of plane to define at least a first contact region a second contact region and a beam region intermediate of the first end second regions, the first and second contact regions being in a resiliently movable disposition relative to each other. Each conductive element is captured with the receiving region yet allowing movement of the contact regions relative to the housing. The capture includes the inter-engagement a locking section of conductive element and of the housing as a result of a cantilevered fixing of the conductive element to the housing in the in plane direction and the biasing of the locking section of the conductive element towards inter engagement as a result of the in plane rigidity of the conductive elements. The movement of the beam region, in the direction parallel to the direction of resilient movement of the first and second contact regions towards each other the, is unrestricted by the interlocking relationship of the locking sections.

27 Claims, 7 Drawing Sheets

ELECTRICAL CONNECTOR

FIELD OF THE INVENTION

The present invention relates to an electrical connector and relates to an electrical connector of a kind which can be used in connecting the circuits of two or more electrical devices which may for example present connection leads in the form of a printed circuit board. In particular although not solely the present invention relates to a double compression electrical connector.

BACKGROUND OF THE INVENTION

Printed circuit boards or IC chip carriers are often required to be connected to a device as an add-on or temporary circuit. Accordingly, convenient to use connectors between such devices are required. With electrical circuits becoming smaller and compact, the electrical connector design is likewise becoming more compact and hence more difficult to achieve. Issues include a reduced lead size in light of closer spaced electrical leads, achieving good contact between the electrical connector and such leads, and simple design and assembly of the electrical connectors.

With reference to U.S. Pat. No. 4,699,593 there is shown an electrical connector having a plurality of conductive elements which merely slide into a connector body. After these conductive elements have been engaged with the connector body, the connector body is inserted into a housing which then securely locates the conductive elements. This arrangement requires a two-part housing arrangement to be provided to securely locate the conductive elements. The conductive elements themselves are formed into a three-dimensional shape by having being individually stamped from a sheet material. Accordingly the conductive elements must be individually handled prior to being assembled with the housing. The assembly of conductive elements with the housing of U.S. Pat. No. 4,699,593 may occur on an individual basis.

U.S. Pat. No. 6,099,356 shows an electrical connector having conductive elements which have been folded from a sheet material. The housing of U.S. Pat. No. 6,099,356 however is a two-part housing. The use of barbs ensures that each electrical connector is retained with the housing at least in one direction.

U.S. Pat. No. 6,231,394 discloses an electrical connector, also formed by folding of a sheet material. This connector utilizes conductive elements which become engaged with a housing by using a clipping feature to clip the conductive element thereafter preventing the conductive element from being removed. The clipping feature of each conductive element must remain stationary and is effectively held stationary as result of its direct engagement with the housing thereby preventing this clipping feature from moving in the X, Y and Z direction. Accordingly such a clipping feature is required to be provided in a region of the conductive element which is not displaced or required to be displaced to ensure the conductive element is provided in a flexible mode for making the electrical connection with the electrical components.

WO 97/32275 discloses a double compression connector engaged with a single piece housing, wherein the double compression connector is made by folding of a sheet material. The conductive elements have folded ends which are presented in a manner to allow each conductive element to be press fitted into a channel of the housing. This rigidly secures that portion of the conductive element from which the ends extend. This portion of the conductive element is rigidly fixed and cannot move when the contact points of the conductive elements are being engaged with an electrical device.

Such existing connector con be complicated to assemble and manufacture and it will be appreciated that the more components there are to a connector assembly, the more time is required to assemble the connector, which increases the cost of manufacture per item. It would hence be an advantage to have a compression connection design that enables the connector to be assembled and manufactured without complicated components, and requiring many steps to assembly, yet still achieve the desirable characteristics of connectors of this kind.

Accordingly it is an object of the present invention to provide an electrical connector which has efficient freedom of movement to allow it to function in a single or double compression mode or which will at least provide the public with a useful choice.

It is further object of the present invention to provide a conductive element for the assembly of an electrical connector which is convenient to handle for assembly purposes or which will at least provide the public with a useful choice.

BRIEF DESCRIPTION OF THE INVENTION

In a first aspect the present invention consists in an electrical connector comprising;

a connector housing including a plurality of cavities, each cavity including a mouth opening at a surface of said housing and having a longitudinal direction extending into said housing and bounded by at least an upper and lower wall and two side walls, a plurality of conductive elements, one located substantially with each said cavity each conductive element having been formed by out of plane bending of a planar sheet material to define at least (a) an upper contact region, (b) a lower contact region, and (c) a beam region intermediate of said upper contact region and said lower contact region which allows said upper contact region and said a lower contact region to be resiliently deflectable towards each other wherein each said conductive element is retained by said housing in a respective said cavity, including by the inter-engagement of a locking section of said beam region with a complementary locking section of said housing within said cavity, said locking section of said beam encouraged to remain engaged with said locking section of the housing in said cavity by the in plane bending rigidity of said conductive element to thereby restrict said conductive element from movement in said longitudinal direction out of said cavity.

Preferably inter-engagement of said locking section of said beam region with the locking section of said housing is only restrictive to the movement of said conductive element in said longitudinal direction out of said cavity.

Preferably said conductive element is engaged to said housing to restrict rotational movement of said locking section of said beam region in the in plane direction, by said conductive element being in cantilever support with said housing in the in plane direction to resist against in plane movement (by bending of said beam region) of said locking region about said cantilevered support to a condition disengaged it from the locking region of said housing in said cavity.

Preferably each said conductive element is restrained from in plane movement at a restraining region said conductive element away from said locking section of said beam relative to and by said housing.

Preferably each said conductive element is restrained from in plane movement at a restraining region of said conductive element thereof away from said locking section of said beam relative to and by said housing, by its location within a slot of said housing extending in the longitudinal direction.

Preferably said restraining region is away from said locking section of said beam in a direction more proximate to said mouth opening.

Preferably each said conductive element is restrained from in plane movement relative to said housing by being restrained by said housing in the in plane direction at at least one of said upper and lower contact regions.

Preferably each said conductive element is shaped to position said upper and lower contact regions adjacent opposing surface of said housing.

Preferably said housing has an upper surface and a lower surface said upper contact region of each said conductive element extending through said upper surface. Preferably said lower contact region of each said conductive element extends through said lower surface of said housing.

Preferably said beam region of each said conductive element is a curved beam region.

Preferably said beam region of each said conductive element is substantially "U" shaped.

Preferably each said conductive element is restricted in movement in the longitudinal direction into said cavity by an end wall of said cavity.

Preferably said locking section of said beam region is an edge or surface thereof presented lateral to the longitudinal direction of said cavity and the normal to which is in a direction towards said mouth of said cavity.

Preferably said locking section of said housing in said cavity is an edge or surface presented parallel to the edge or surface of the locking region of said beam region and the normal to which is in a direction away from said mouth of said cavity.

Preferably said electrical connector is a double compression connector wherein said a upper contact region and said a lower contact region of each said conductive elements are each movable relative to said housing in a direction towards each other.

Preferably said cavity includes a ramp rising in the longitudinal direction into said cavity from said mouth opening from a side wall thereby presenting a ramp surface non parallel to the longitudinal direction, said ramp terminating at said locking surface of said housing of said cavity.

Preferably said beam region includes two said locking regions, one provided at each parallel portion of said substantially "U" shaped beam region of each said conductive element.

Preferably each said conductive element includes two restraining region, one each at said upper and lower contact region each said restraining region captured in the in plane direction between side facing walls of a respective slot of the housing between said upper and lower surfaces of said housing and said cavity and through which said upper and lower contact regions respectively extend.

In a second aspect the present invention consist in an array of conductive elements comprising a plurality of longitudinal conductive elements of a double compression contact kind which each include a first contact region and a second contact region, intermediate of which there is a beam region which locates said first and second contact regions in a resiliently moveable disposition to each other, said array having been formed from a single sheet of conductive material to define each said conductive elements by out of plane folding, said plurality of conductive elements being held in juxtaposition to each other by and frangibly disposed from a rail section of said sheet material.

Preferably said beam of each said conductive element is substantially "U" shaped. Preferably said second contact region of each said conductive element is provided at or towards a free end of such conductive element away from said rail section.

Preferably each said conductive element includes at said beam region, a locking section comprising of an edge or surface of said sheet material, the normal to which is not perpendicular to the longitudinal direction of said conductive element.

Preferably said locking section is provided at a section of said conductive element intermediate of the curved section of said beam region and one of (a) said first contact region and (b) said second contact region.

Preferably two said locking sections are provided, one each at parallel section of said beam region.

Preferably said locking section is an increase in the in plane width of said conductive element, in a longitudinal direction away from said rail section.

Preferably said locking section is a step in a longitudinal side of said conductive element.

Preferably each said conductive element includes at said beam region, a locking section comprising of an edge or surface of said sheet material, the normal to which parallel to the longitudinal direction of said conductive element.

In still a further aspect the present invention consists in an electrical connector comprising;

a housing having a plurality of conductive element receiving regions, a plurality of conductive elements, one each received in by said receiving regions, said conductive elements being of a kind formed from an elongate sheet material which has been bent out of plane to define at least a first contact region a second contact region and a beam region intermediate of said first end second regions, said beam region holding said first and second contact regions in a resiliently movable disposition relative to each other, said conductive element is captured with said receiving region yet allowing movement of at least one of said first and second contact regions relative to said housing, said capture including the inter-engagement a locking section of conductive element and of said housing as a result of a cantilevered fixing of said conductive element to said housing in the in plane direction and the biasing of said locking section of said conductive element towards inter engagement thereof with said locking section of said housing as a result of the in plane rigidity of said conductive elements, wherein movement of the beam region, in the direction parallel to the direction of resilient movement of said first and second contact regions towards each other said, is unrestricted by said interlocking relationship of said locking sections.

DETAILED DESCRIPTION OF THE INVENTION

Figure 1:
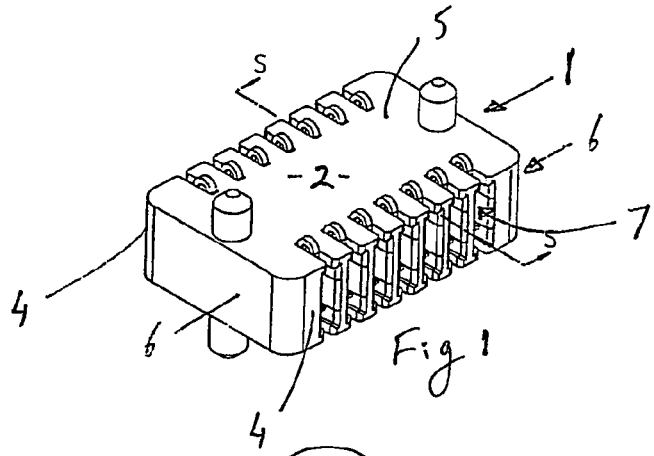
FIG. 1 is a perspective view of an electrical connector illustrating two arrays of conductive elements presented for contact with electrical components.
Figure 2:
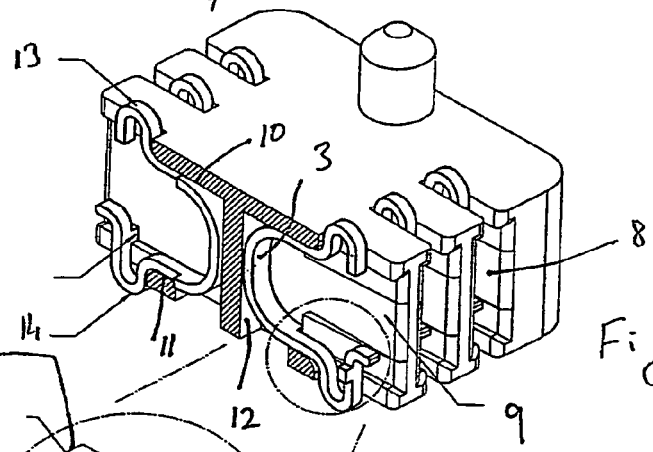
FIG. 2 is a sectional view through section S—S of FIG. 1 illustrating part of the interior of two cavities within each of which there is provided a conductive element.

With reference to FIG. 1, there is shown an electrical connector 1. The connector consists of a housing 2 which is preferably unitary and made of a single piece of material. The material is preferably an insulating material such as plastic. The housing 2 provides regions for locating conductive elements 3 in a manner to form at least one array of conductive elements positioned adjacent each other. With reference to FIG. 1, it can be seen that the electrical connector preferably provides two arrays, one disposed at or towards each side 4 of the housing 2.

The housing itself includes an upper surface 5, a lower surface (not shown), side surfaces 4 and end surfaces 6.

The location regions within with which conductive elements are each respectively able to locate are cavities 7 provided within the housing. The cavities are provided extending in through a side surface of the housing. They are of a longitudinal nature extending into the housing from the side surface in the Z direction. Each cavity includes a mouth opening 8 at side surfaces 4, sidewalls 9, upper and lower walls 10, 11 and preferably an endwall 12. Such walls may not be continuous and may provide further openings into adjacent cavities or elsewhere other than through the mouth region 8. Openings may for example be through the upper surface 5 and lower surface of the housing, through which a part of each conductive element is able to extend. Such parts of the conductive element are for example the upper and lower contact regions 13, 14. The side and upper and lower walls need not be continuous nor provide complete enclosure for the cavity.

Whilst the lower contact region of 14 of a conductive element extends through or from the lower surface of the housing, alternatively such may be provided to extend from the side surface 4 of the housing.

Figure 4:
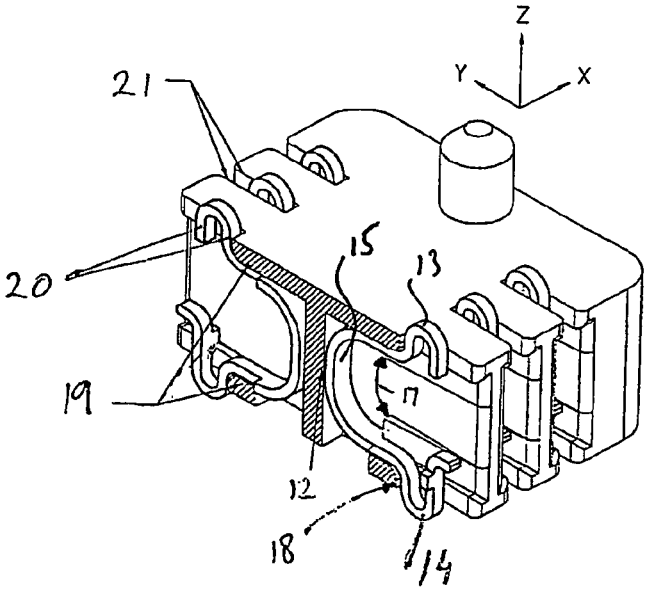
FIG. 4 is the same view as FIG. 2.
Figure 15:
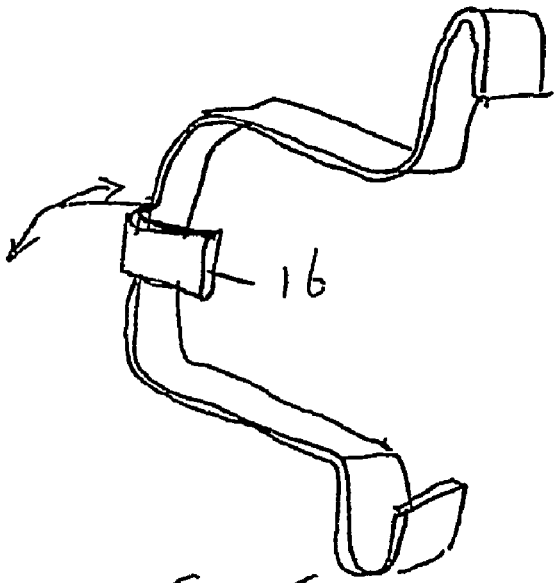
FIGS. 15–16 illustrate alternative shapes of conductive elements which may locate with a housing in a substantial similar mode to that of the most preferred form as shown in FIG. 2.
Figure 16:
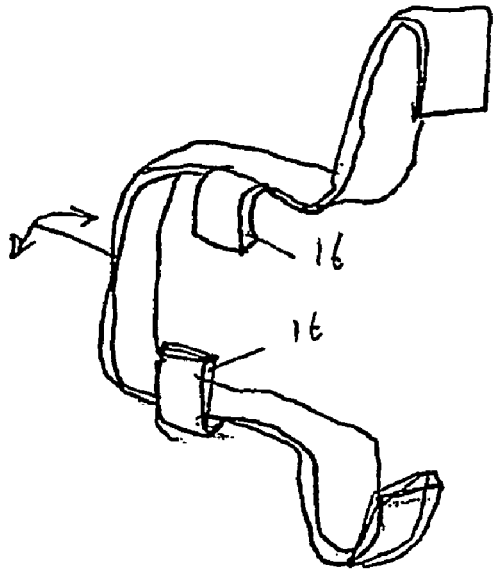

Each conductive element is preferably an elongate shape, and includes an upper and lower contact region 13, 14 between which there extends a resilient beam region 15 which is preferably of a substantially "U" shaped form. This beam region may alternatively be "V" shaped or other shape which is folded or bent or curved. A "U" shape provides a good and sufficient degree of resilience to the movement of the upper and lower contacted regions towards each other. Such resilience is required since it provides the biasing force of the conductive element towards an electrical device. Each conductive element is formed by bending a sheet material into the curved form of the conductive element as shown in for example FIG. 4. The sheet material itself is firstly stamped from a sheet whereafter it is then folded/bent, to the form as for example shown. The conductive element after having been stamped from a sheet material, is formed into the curved shape by out of plane bending. By out of plane bending, we refer to the bending of the precursor planar form of the conductive element in a direction normal to the plane thereof. The conductive element still maintains a general in-plane direction even though no longer planar. The in-plane direction with reference to FIG. 4, is in direction X. Whilst some upstands may be folded out of the X plane direction (see for example FIGS. 15 and 16), a substantial part of the conductive element remains in-plane. Each conductive element has at its beam region a locking section 16. This locking section 16 becomes engaged with a corresponding locking section 17 of the housing provided within the cavity.

The inter-engagement of the locking section 16 with the locking section 17 needs to be such that it provides an unrestricted movement of the beam region in the Z direction, being the direction in which the contact regions 13, 14 are displaced towards each other during compression engagement. Since the locking section 16 can be provided anywhere on the beam region, and since substantially all of the beam region will displace in a Z direction upon compression engagement with the contact regions 13, 14, such inter-engagement needs to be free from restricting the movement of the beam region in the Z direction. Accordingly the surface or edges of the locking section 16, 17 are parallel to any plane through the Z axis and are preferably parallel to the Z-X axes plane.

Figure 3:
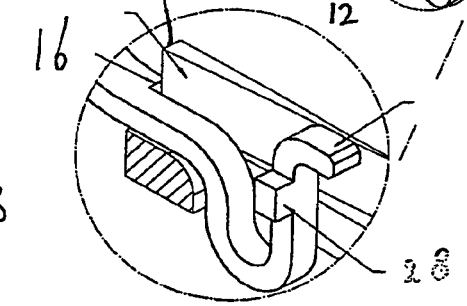
FIG. 3 is a close up preview of a region of FIG. 2.

The inter-engagement of the locking section 16 with the locking section 17, whilst allowing movement of the beam in the Z direction prevents movement of the beam in the Y direction towards the mouth 8 of the cavity. Accordingly the locking sections of the beam and of the housing within the cavity, are not parallel to the Z-Y plane, and are indeed transverse and preferably at 90 degrees thereto. This is as for example shown in FIG. 3.

Displacement of the beam further into the cavity in the Y direction is preferably prevented by an endwall region of the endwall 12 and/or by any other surface of the housing able to engage with a portion of the connector in this direction. An alternative or additional region other than the end of the beam may be used to prevent this movement, such as for example region 18. Movement of the connector in a Z direction to limit the displacement of the contact regions 13, 14 away from each other is preferably limited by upper and lower wall surfaces at for example points 19.

With reference to FIG. 4, there can be seen two locking sections 17 within the cavity, to engage with two corresponding locking sections 16 of a conductive element. Such locking sections are provided to prevent movement in the Y direction at sections of the beam which are substantially parallel to each other. The locking section of the beam region can then be conveniently provided by a step in the longitudinal side of the conductive element, preferably where the "U" shaped beam is parallel. The locking sections of the housing are hence provided adjacent the upper and lower walls of the cavity.

Alternatively the locking section may be provided more proximate to the endwall and may be provided to lock with the mouth opening facing surface of beam region.

The conductive element is restrained from being disengaged with the locking section 17 of the housing by being restrained against movement in the X direction. Such restraint is preferably provided by the engagement of a restraining region of the conductive element which locates with said housing. Such a restraining region is preferably provided at the contact regions 13 and 14. The retaining region 20 is able to locate within two walls 21 of the housing through which the connection regions extend. These two wall surfaces are preferably provided by a slot through the housing and into the cavity. The two walls of the slot locate against the restraining regions of the conductive element and prevent the conductive element at this point from moving in the X direction, whether such is by displacement or by rotation. The retention of the conductive element ensures engagement of the locking sections 16, 17 is maintained due to the inherent resilience of the material of the conductive element against in-plane bending thereof. However such in-plane bending is possible and indeed this is what is relied on during the assembly of the electrical connector and to maintain engagement of each conductive element with the housing when fully assembled.

Figure 5:
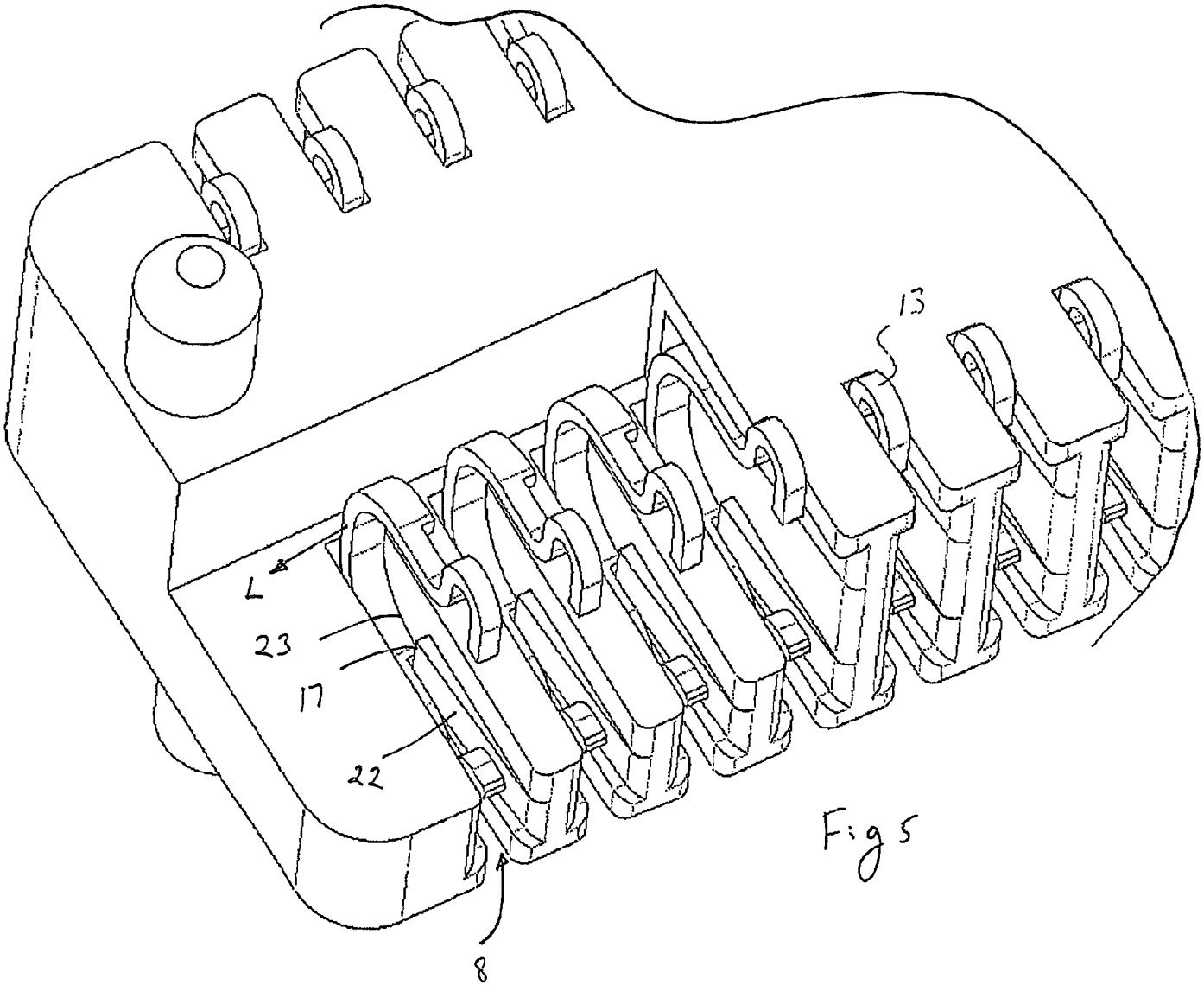
FIG. 5 is a perspective and part cut-away view of part of the electrical connector of FIG. 1.
Figure 6:
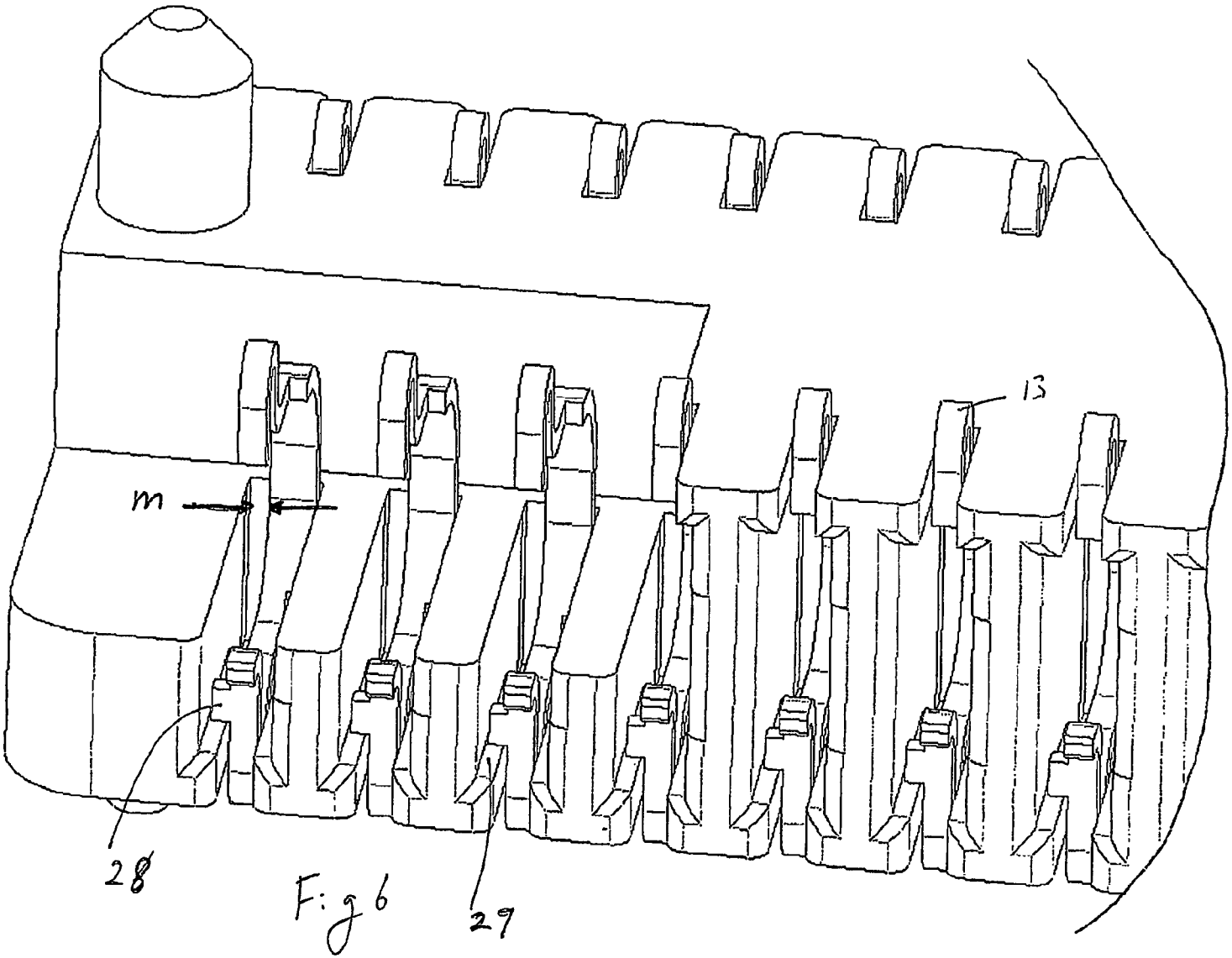
FIG. 6 is a perspective and part cut-away view of part of the electrical connector of FIG. 1.
Figure 7:
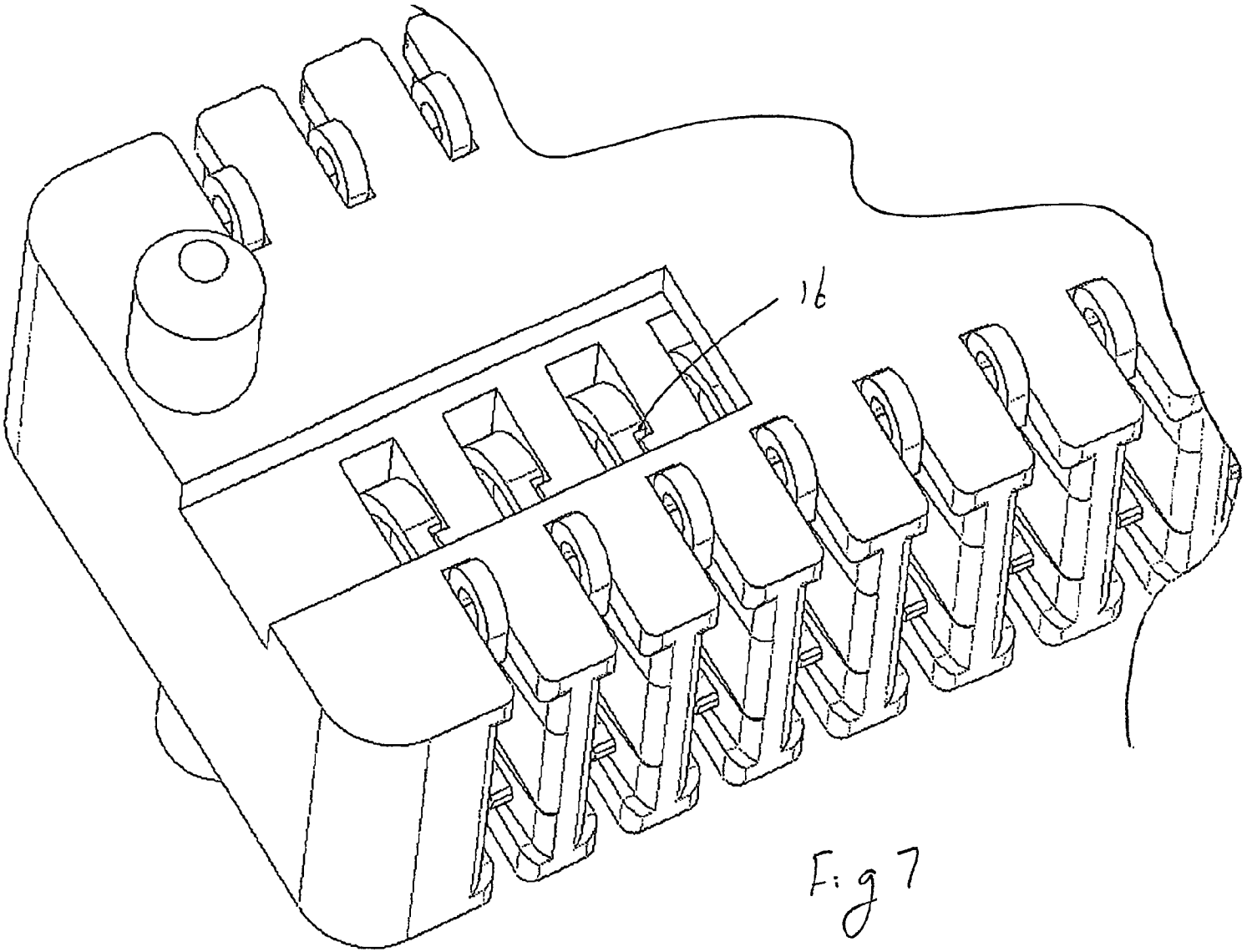
FIG. 7 is a perspective and part cut-away view of part of the electrical connector of FIG. 1.
Figure 8:
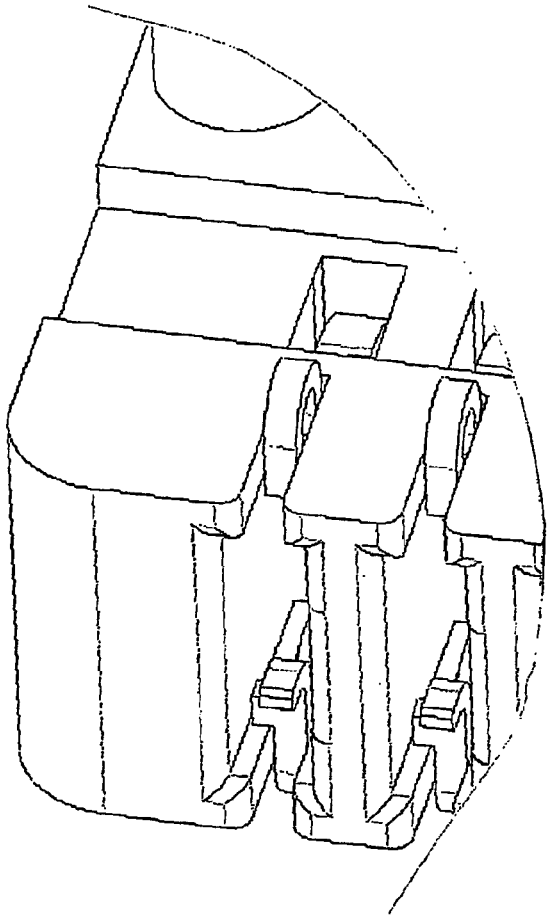
FIG. 8 is a perspective and part cut-away view of part of the electrical connector of FIG. 1.
Figure 9:
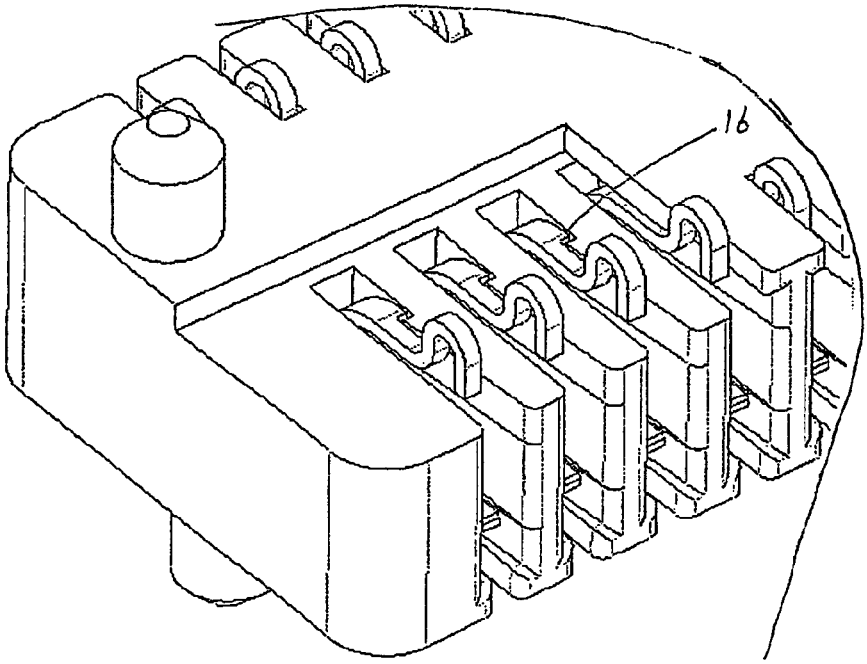
FIG. 9 is a perspective and part cut-away view of part of the electrical connector of FIG. 1.

With reference to FIG. 5, it can be seen that the locking section 17 of the housing has an associated ramp portion 22. This ramp portion is provided to allow that edge 23 of the beam to slide there on, as the conductive element is inserted (preferably beam region first) into the cavity through the mouth opening 8 in the longitudinal, (mouth-to-endwall) direction. The ramp 22 will upon displacement of the conductive element into the cavity, bend the beam region in direction L until such time as the locking section 16 becomes aligned with the locking section 17. As a result of the restraint against rotation of the conductive element about the Z-axis, when the locking sections are aligned, (provided by the restraining region 20 being engaged with the slots 21) the deflected beam region under a resilient bending moment will move in the direction opposite to L. This beam snaps the conductive element into its fully assembled condition, locking against the movement of the conductive element in the Y direction out of the cavity by the interlocking of the locking sections 16, 17. The sidewall opposite to sidewall 9 of the cavity is shaped such that a displacement of the beam in direction L is possible. For example shown in FIG. 6, a clearance M is provided, such clearance being sufficient for displacement of the beam in the L direction as the conductive element is inserted into the cavity. During insertion an in-plane bending of the beam about the retention region 20 of the conductive element occurs because of the resilient nature of the material.

Figure 11:
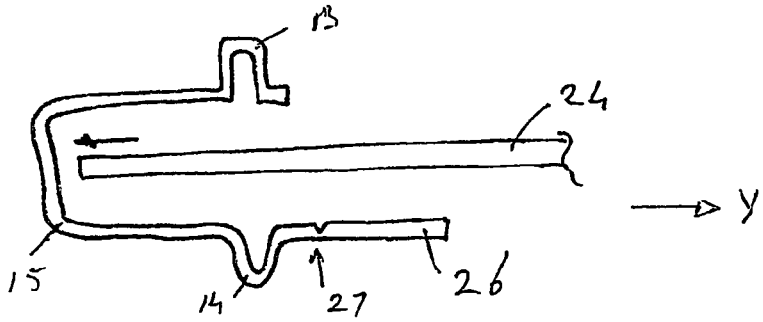
FIG. 11 is a side view of the array of conductive elements illustrating that a tool may be used to aid in the insertion of each conductive element into a perspective cavity.

During engagement of the conductive element with the housing, it is desirable for a tool 24 to be provided to push against the beam region to deliver the conductive element to a fully assembled condition with the housing. With reference to FIG. 11, such a tool would need to be of an elongated nature to allow its insertion into the cavity. The tool would engage with that surface of the beam region which is projected towards the mouth opening 8. Since conductive elements used for today's applications are very small and the cavity width is small, such a tool would need to be small yet have good rigidity in order to be useful in pushing against the beam region of a conductive element. Such rigidity will come about from material choice but also from sizing. Because the provision of a ramp narrows to width of the cavity, (at least that width which is line of sight with the mouth opening) that portion of the cavity in alignment with the mouth opening and with that surface of the beam region projecting towards the mouth opening, is absent of such a ramp. Hence the preferred positioning of the locking sections at regions of the beam parallel to each other. By being absent of a ramp a greater width to the cavity is achieved through the middle of the cavity. Thereby a tool 24 of a greater width (hence greater strength) can be inserted into the cavity to reach and push against the beam region.

Figure 12:
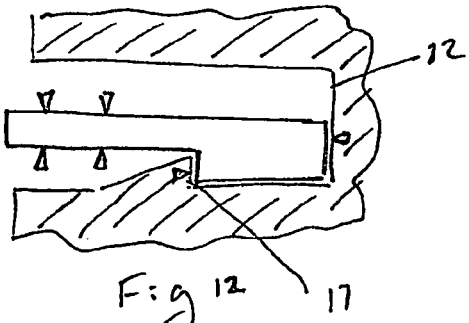
FIG. 12 is a sectional view through a cavity of the electrical connector illustrating one mode of interconnection between a conductive element and the housing.
Figure 13:
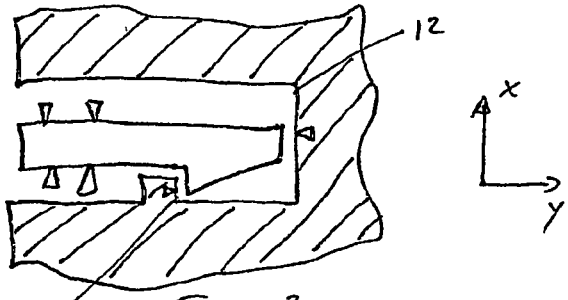
FIG. 13 illustrates an alternative mode.
Figure 14:
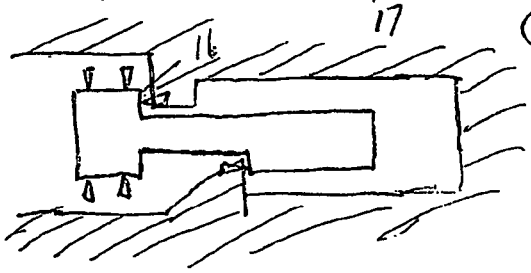
FIG. 14 is a plan view of a conductive element illustrating an alternative region where the conductive element can be provided to restrain its movement in a longitudinal direction inwards into the cavity, where herein the movement in the y direction is not restrained at the end wall 14 but more proximate to the mouth opening of the cavity

Whilst in the preferred form, it is the housing within the cavity which provides the ramped surface 22 which is non parallel to the slots (between surfaces 21) retaining the retaining sections of the conductive elements, as for example shown in FIG. 12, alternatively the connector 13 may be provided with a ramped surface which, in conjunction with an upstand of the sidewall of the housing within the cavity, induces a bending moment in the beam during its insertion into the cavity. Such an arrangement is for example shown in FIG. 13. FIGS. 12 and 13 also show that the locking section 17 within the cavity of the housing prevents movement of the conductive element in one direction along the Y axis and the endwall 12 prevents movement in an opposite direction along the X axis. With reference to FIG. 14, it need not be the endwall 12 which provides restraint of movement of the conductive element in such an opposite direction. It may indeed be another surface of the housing which locates with the locking surface 16 of the conductive element to provide such restraint.

Whilst herein we have mentioned that movement may be restrained, it is to be noted that the conductive element may loosely fit within the cavity and the restraint of movement may be between limits and not necessarily absolute. Hence the conductive element may for example be captured by the locking element 17 and the endwall 12 in a manner such that the conductive element can move within limits in the Y axis direction.

Figure 10:
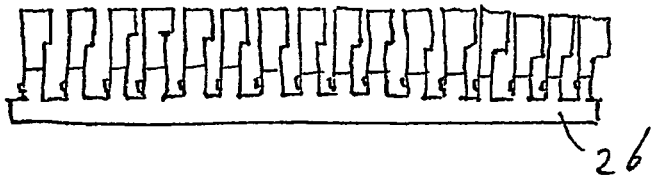
FIG. 10 is a plan view of an array of conductive elements prior to being assembled with the housing.

Each conductive element of the electrical connector of the present invention is preferably inserted as part of an array, substantially simultaneously. To this extend a plurality of conductive elements are formed from a sheet of material by out of plane folding in a manner to position such conductive elements adjacent to each other. FIG. 10 illustrates a plan view of such an array of conductive elements and wherein such conductive elements are each connected to each other by a rail member 26. This rail member 26 connects all conductive elements together and allows for all conductive elements to be handled simultaneously. Each conductive element is however frangible from the rail preferably by a line of weakness 27 provided between the rail and each conductive element. This line of weakness 27 is frangible and by bending, separates the rail from the conductive elements. In the array form as shown in FIG. 10, all conductive elements are spaced apart, at cavity spaced intervals thereby allowing for all conductive elements to be simultaneously inserted into a respective cavity. Once the conductive elements are inserted, the rail 26 can be frangibly detached. Such frangible detachment may be by for example folding the rail downwardly. To reduce the impact of such downward folding of the rail to the conductive elements, each conductive element has been provided with a lug 28 which is for example seen in FIG. 6. The lug is able to be supported by an upward facing surface 29 which during downward bending of the rail will support the conductive element proximate to the frangible area 27 and thereby reduce any distortional effects that such downward bending may have on the conductive elements.

The invention described herein is susceptible to variations, modifications and/or additions other than those specifically described and it is to be understood that the invention includes all such variations, modifications and/or additions which fall within the spirit and scope of the above description.

The invention claimed is:

1. A dual compression electrical connector comprising;

a connector housing including a plurality of cavities arranged in a row in a lengthwise direction of said connector housing, each cavity including a mouth opening at a surface of said housing and having a longitudinal direction extending from said mouth into said housing and bounded by at least an upper and lower wall and two side walls, a plurality of conductive elements, one located substantially with each said cavity, each conductive element having been formed by out of plane bending of a planar sheet material to define at least (a) an upper contact region, (b) a lower contact region, and (c) a beam region intermediate of said upper contact region and said lower contact region which allows said upper contact region and said a lower contact region to be resiliently deflectable towards each other, wherein each said conductive element is retained by said housing in a respective said cavity including by the inter-engagement of a locking section of said beam region with a complementary locking section of said housing within said cavity, said locking section of said beam encouraged to remain engaged with said locking section of the housing in said cavity by in plane bending rigidity of said conductive element to thereby restrict said conductive element from movement in said longitudinal direction out of said cavity.

2. A dual compression electrical connector as claimed in claim 1 wherein inter-engagement of said locking section of said beam region with the locking section of said housing is only restrictive to the movement said conductive element in said longitudinal direction out of said cavity.

3. A dual compression electrical connector as claimed in claim 1 wherein said conductive element is engaged to said housing to restrict rotational movement of said locking section of said beam region in the in plane direction, by said conductive element being in cantilever support with said housing in the in plane direction to resist against in plane movement (by bending of said beam region) of said locking region about said cantilevered support to a condition disengaged it from the locking region of said housing in said cavity.

4. A dual compression electrical connector as claimed in claim 1 wherein each said conductive element is restrained from in plane movement at a restraining region of said conductive element thereof away from said locking section of said beam relative to and by said housing, by its location within a slot of said housing extending in the longitudinal direction.

5. A dual compression electrical connector as claimed in claim 1 wherein each said conductive element is restrained from in plane movement relative to said housing by being restrained by said housing in the in plane direction at, at least one of said upper and lower contact regions.

6. A dual compression electrical connector as claimed in claim 1 wherein each said conductive element is shaped to position said upper and lower contact regions adjacent opposing surface of said housing.

7. A dual compression electrical connector as claimed in claim 1 wherein said beam region of each said conductive element is a curved beam region.

8. A dual compression electrical connector as claimed in claim 1 wherein said beam region of each said conductive element is substantially "U" shaped.

9. A dual compression electrical connector as claimed in claim 1 wherein each said conductive element is restricted in movement in the longitudinal direction into said cavity by an end wall of said cavity.

10. A dual compression electrical connector as claimed in claim 1 wherein said locking section of said beam region is an edge or surface thereof presented lateral to the longitudinal direction of said cavity and the normal to which is in a direction towards said mouth of said cavity.

11. A dual compression electrical connector as claimed in claim 1 wherein said locking section of said housing in said cavity is an edge or surface presented parallel to the edge or surface of the locking region of said beam region and the normal to which is in a direction away from said mouth of said cavity.

12. A dual compression electrical connector as claimed in any claim 1 wherein said electrical connector is a double compression connector wherein said a upper contact region and said a lower contact region of each said conductive elements are each movable relative to said housing in a direction towards each other.

13. A dual compression electrical connector as claimed in claim 1 wherein said cavity includes a ramp rising in the longitudinal direction into said cavity from said mouth opening from a side wall thereby presenting a ramp surface non parallel to the longitudinal direction, said ramp terminating at said locking surface of said housing of said cavity.

14. A dual compression electrical connector as claimed in claim 1 wherein said beam region includes two said locking regions, one provided at each parallel portion of said substantially "U" shaped beam region of each said conductive element.

15. A dual compression electrical connector as claimed in claim 1 wherein each said conductive element is restrained from in plane movement at a restraining region of said conductive element away from said locking section of said beam relative to and by said housing.

16. A dual compression electrical connector as claimed in claim 15 wherein said restraining region is away from said locking section of said beam in a direction more proximate to said mouth opening.

17. A dual compression electrical connector as claimed in claim 15 wherein each said conductive element includes two restraining region, one each at said upper and lower contact region each said restraining region captured in the in plane direction between side facing walls of a respective slot of the housing between said upper and lower surfaces of said housing and said cavity and through which said upper and lower contact regions respectively extend.

18. A dual compression electrical connector as claimed in claim 1 wherein said housing has an upper surface and a lower surface said upper contact region of each said conductive element extending through said upper surface.

19. A dual compression electrical connector as claimed in claim 18 wherein said lower contact region of each said conductive element extends through said lower surface of said housing.

20. An array of conductive elements comprising a plurality of longitudinal conductive elements of a dual compression contact kind which each include a first contact region and a second contact region, intermediate of which there is a beam region which locates said first and second contact regions in a resiliently moveable disposition to each other, said array having been formed from a single sheet of conductive material to define each said conductive elements by out of plane folding, said plurality of conductive elements being held in juxtaposition to each other by and frangibly disposed from a rail section of said sheet material, wherein said beam of each said conductive element is substantially "U" shaped, and wherein each said conductive element includes at said beam region, a locking section comprising of an edge or surface or said sheet material, the normal to which is not perpendicular to the longitudinal direction of said conductive element.

21. An array of conductive elements as claimed in claim 20 wherein said second contact region of each said conductive element is provided at or towards a free end of such conductive element away from said rail section.

22. An array of conductive elements as claimed in claim 20 wherein said locking section is provided at a section of said conductive element intermediate of the curved section of said beam region and one of (a) said first contact region and (b) said second contact region.

23. An array of conductive elements as claimed in claim 20 wherein two said locking sections are provided, one each at parallel section of said beam region.

24. An array of conductive elements as claimed in claim 20 wherein said locking section is an increase in the in plane width of said conductive element, in a longitudinal direction away from said rail section.

25. An array of conductive elements as claimed in claim 20 wherein said locking section is a step in a longitudinal side of said conductive element.

26. An array of conductive elements as claimed in claim 20 wherein each said conductive element includes at said beam region, a locking section comprising of an edge or surface of said sheet material, the normal to which parallel to the longitudinal direction of said conductive element.

27. An electrical connector comprising;

a housing having a plurality of conductive element receiving regions, a plurality of conductive elements, one each received in by said receiving regions, said conductive elements being formed from an elongate sheet material which has been bent in an out of plane direction to define at least a first contact region, a second contact region and a beam region intermediate of said first and second contact regions, said beam region holding said first and second contact regions in a resiliently movable disposition relative to each other, said conductive element is captured with said receiving region yet allowing movement of at least one of said first and second contact regions relative to said housing, said capture including inter-engagement of a locking section of each conductive element and of said housing as a result of a cantilevered fixing of said conductive element to said housing in an in plane direction, and biasing of said locking section of said conductive element towards the inter-engagement thereof with said locking section of said housing as a result of in plane rigidity of said conductive elements, wherein movement of the beam region, in a direction parallel a to direction of resilient movement of said first and second contact regions towards each other said, is unrestricted by interlocking relationship of said locking sections with said housing by said inter-engagement.

* * * * *